United States Patent [19]

Kelly

[11] 4,436,469

[45] Mar. 13, 1984

[54] AUXILIARY FEED HOPPER FOR PERMITTING THE TRIMMING, IN A SADDLE BINDER OF PERFECT BOUND BOOKS

[76] Inventor: Eugene L. Kelly, 814 W. Shermoor St., Peoria, Ill. 61614

[21] Appl. No.: 373,094

[22] Filed: Apr. 29, 1982

[51] Int. Cl.[3] ..... B42C 19/12; B65H 1/00

[52] U.S. Cl. ..... 412/16; 271/171

[58] Field of Search ..... 412/16; 271/171, 223, 271/224

[56] References Cited

U.S. PATENT DOCUMENTS

| | | | |
|---|---|---|---|
| 1,076,726 | 10/1913 | Welch | 412/16 |
| 1,635,165 | 7/1927 | Adamsky | 412/16 |
| 2,922,171 | 1/1960 | Kleineberge | 412/16 |
| 2,956,295 | 10/1960 | Kleineberg et al. | 412/16 |
| 3,093,396 | 6/1963 | Segreto | 412/16 |
| 3,167,987 | 2/1965 | McCain | 412/16 |
| 3,188,667 | 6/1966 | Blair | 412/16 |
| 3,250,162 | 5/1966 | Bunting | 412/16 |
| 4,343,461 | 8/1982 | Sunichi et al. | 271/171 |

FOREIGN PATENT DOCUMENTS

| | | | |
|---|---|---|---|
| 843211 | 6/1970 | Canada | 412/16 |

*Primary Examiner*—E. R. Kazenske
*Assistant Examiner*—Paul M. Heyrana
*Attorney, Agent, or Firm*—Leydig, Voit, Osann, Mayer & Holt, Ltd.

[57] ABSTRACT

An auxiliary feed hopper for permitting the trimming, in a saddle binder, of perfect bound books which includes a horizontal base plate having a pair of longitudinally extending slots. The base plate is supported above the delivery bed with the slots in register with the lug slots normally provided in the delivery bed. A rear stock plate is secured to the base plate, and supporting brackets at the side edges of the base plate are clamped in positions equally from the stock plate. A front stock guide is provided including a bridge spaced above the base plate, the bridge being supported at its ends upon the brackets. Side stock guides are spaced parallel to one another on the base plate, the guides all being adjustably movable on the base plate for receiving, between them, a stack of perfect bound books. A barrier adjustably secured to the bridge, and projecting downwardly therefrom, forms a gap to permit the lowermost book in the stack to feed under the bridge while holding back the remainder of the stack. The base plate is supported on the bed pedestals which are adjustable in height and horizontally spaced from one another for elevating the base plate on the delivery bed to such height that only the tips of the lugs project through the longitudinally extending slots, with the height of the tips above the base plate being less than the height of the gap under the barrier.

7 Claims, 7 Drawing Figures

AUXILIARY FEED HOPPER FOR PERMITTING THE TRIMMING, IN A SADDLE BINDER OF PERFECT BOUND BOOKS

In the binding of magazines and books of magazine thickness, two types of bindings are in use. The most common type of binding for magazines, especially in relatively thin format, is referred to as "saddle" binding in which all of the sheets, folded in the middle, are gathered together by a series of staples spaced end to end along the bound edge. Saddle binders intended for high production, on the order of 15,000 books per hour or more, consist of a number of subassemblies integrated for synchronous operation. Such "unitized" machines are quite costly and generally include a signature feeder, or "pocket," a saddle, a caliper, a stitcher, a delivery bed, a trimmer, and a delivery all serviced by a continuous conveyor assembly. The trimmer in a high production machine is most commonly of the "three-knife" type synchronized with the advancement of the conveyor to trim the front, head and foot of the books with means for thereafter delivering and stacking the books ready for packing. The trimming knives are adjustable, as is well known, to produce a finished product of any desired dimension. A typical commercially available machine falling into this category in the McCain Unitized Saddle Binder manufactured by McCain Manufacturing Corp., 6200 West 60th Street, Chicago, Ill. 60638.

A second type of binding referred to in the art as "perfect," occurs upon stacking a series of folded signatures flatly one on top of another to form a spine or back which is of squarish cross section, with the stacked signatures being subsequently glued together along the bound edge or secured together by stitching or staples which are inserted perpendicularly to the plane of the sheet. The production of perfect bound copies calls for a different type of binding machine, also quite costly, requiring trimming and stacking as the final production steps.

The need often arises to trim perfect bound volumes after they have been assembled and glued, or stitched, on a free standing assembling and binding machine. This has, in the past, required the bindery to invest in a separate trimmer including a feeder intended for synchronized feeding of perfect bound books. Such separate trimmer with automatic feeding device is, of itself, quite costly, particularly in the case of a high production three-knife machine where the cost can run to six figures. When perfect bound books are being run in a bindery, the unitized saddle binder, including its built-in high production trimmer, will often be standing idle.

It is, accordingly, an object of the present invention to provide, in a saddle binder, an auxiliary feed hopper constructed and mounted in such a way as to permit the trimming of perfect bound books. It is a more specific object to provide, in unitary saddle binder, an auxiliary feed hopper which may be easily and quickly secured, as needed, to the delivery bed in a position just ahead of the trimming assembly for utilization of the trimming assembly in the trimming of perfect bound books, and their subsequent delivery—all without requiring any reconstruction, modification or tampering with the saddle binder in any way which would affect its normal production of finished books of the saddle bound type.

It is a related object to provide an auxiliary feed hopper for securing to the delivery bed of a saddle binding machine which utilizes, for the timing and transport of perfect bound books, the conveyor which forms a permanent part of the saddle binder. Consequently, it is an object to provide an auxiliary feed hopper which holds and dispenses perfect bound books at a precise time synchronized with the operation of the trimming knives, deriving its power to do so from the saddle machine to which it is attached and which is of simple construction, fully self-contained with no moving parts and requiring no electrical hookup and no modification of the delivery bed, except to ensure the provision of through-holes, normally provided, for the reception of a pair of spring loaded stabilizer bolts.

It is another object to provide an auxiliary feed hopper for timed feeding of perfect bound books in a saddle type binding machine which is highly versatile and capable of quick and precise adjustment to a wide range of page size and volume thickness.

It is yet another object of the present invention to provide an auxiliary feed hopper for use in a saddle type binding machine which may be adjusted to any desired book thickness within the cutting capability of the associated trimmer and which is highly reliable in feeding such volumes from the hopper one by one employing only the conveyor of the saddle binder.

Indeed, it is an object of the present invention to multiply the production rate of the trimmer on a saddle binder, which is normally limited to the feeding of books one by one, by adjusting the height and thickness settings of the auxiliary feed hopper to release, for simultaneous trimming, two, or even three or more, books at a time limited only by thickness cutting capability of the trimming knives.

It is yet another object of the invention to provide an auxiliary feed hopper which is not limited to use on a particular band or size of saddle binding installation but which may be used almost universally on unitized saddle binder machines produced by different manufacturers in the field. For example, the same model of auxiliary feed hopper may be used for the feeding of perfect bound books in saddle binders having conveyors with a wide range of lug height and lug spacing for synchronized feeding of books to the trimmer either singly or in predetermined multiple.

It is an object of the present invention, in one of its aspects, to provide, in a saddle binder, an auxiliary feed hopper constructed and mounted in such a way as to permit the trimming of saddle bound books and perfect bound books simultaneously—all without requiring any reconstruction, modification or tampering with the saddle binder in any way which would affect its normal production of finished books of the saddle bound type. Consequently, it is an object to provide an auxiliary feed hopper which holds and dispenses perfect bound books at a precise time synchronized with the delivery of saddle bound books. The same infeed lugs which move longitudinally along the delivery bed transporting a wire stitched book under the auxiliary feed hopper will also engage the front edge of the perfect bound book and slidably remove the perfect bound book from the bottom of the book stack and under the front vertical stock supports.

It is a detailed object of the invention, in one of its aspects, to utilize, in addition to the conveyor or infeed lugs of a saddle binder, an auxiliary conveyor belt which is associated with the lugs on some commercial forms of saddle binder by the simple expedient of training the conveyor belt, formed in one or more section, over the base plate of the hopper.

It is a general object of the invention to provide an auxiliary feed hopper which is quickly installed and adjusted, and easily removed, by persons having limited skill or experience, which is durably constructed so that it may be used indefinitely free of wear and without attention or maintenance, and which is at the same time highly economical.

Other objects and advantages of the invention will become apparent upon reading the attached detailed description and upon reference to the drawings in which.

Figure 2:
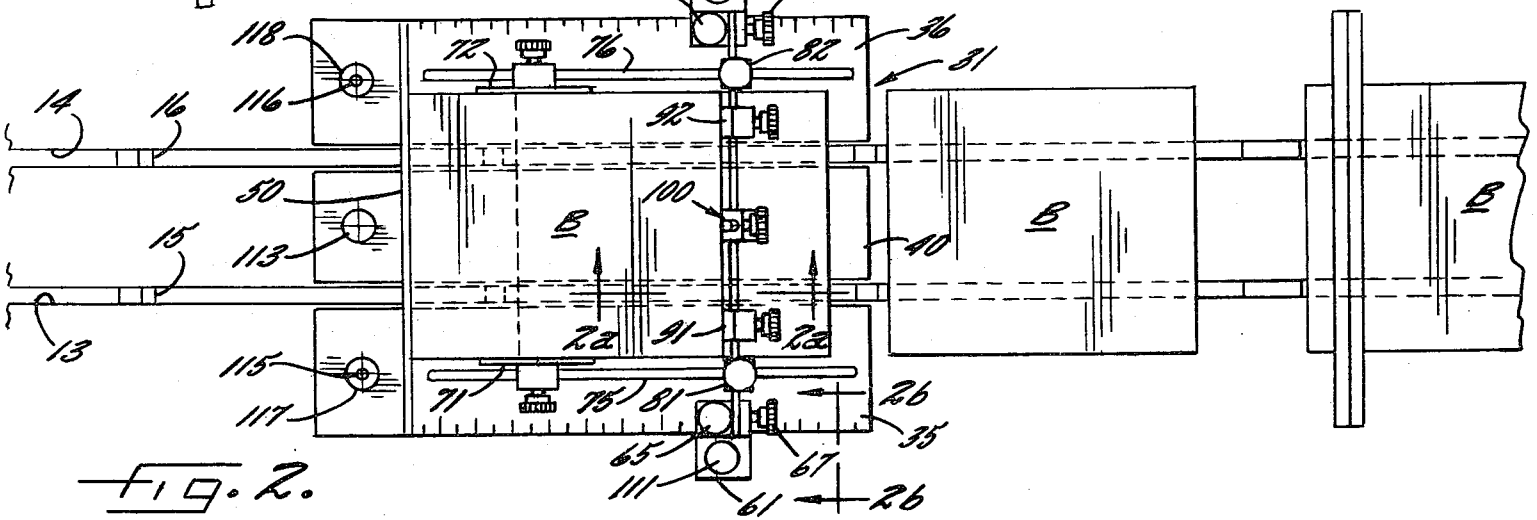
FIG. 2 is a diagrammatic top view corresponding to FIG. 1.

FIG. *2a* is a vertical section taken fragmentarily along line *2a—2a* in FIG. 2.

FIG. *2b* is a vertical section taken along line *2b—2b* in FIG. 2.

Figure 3:
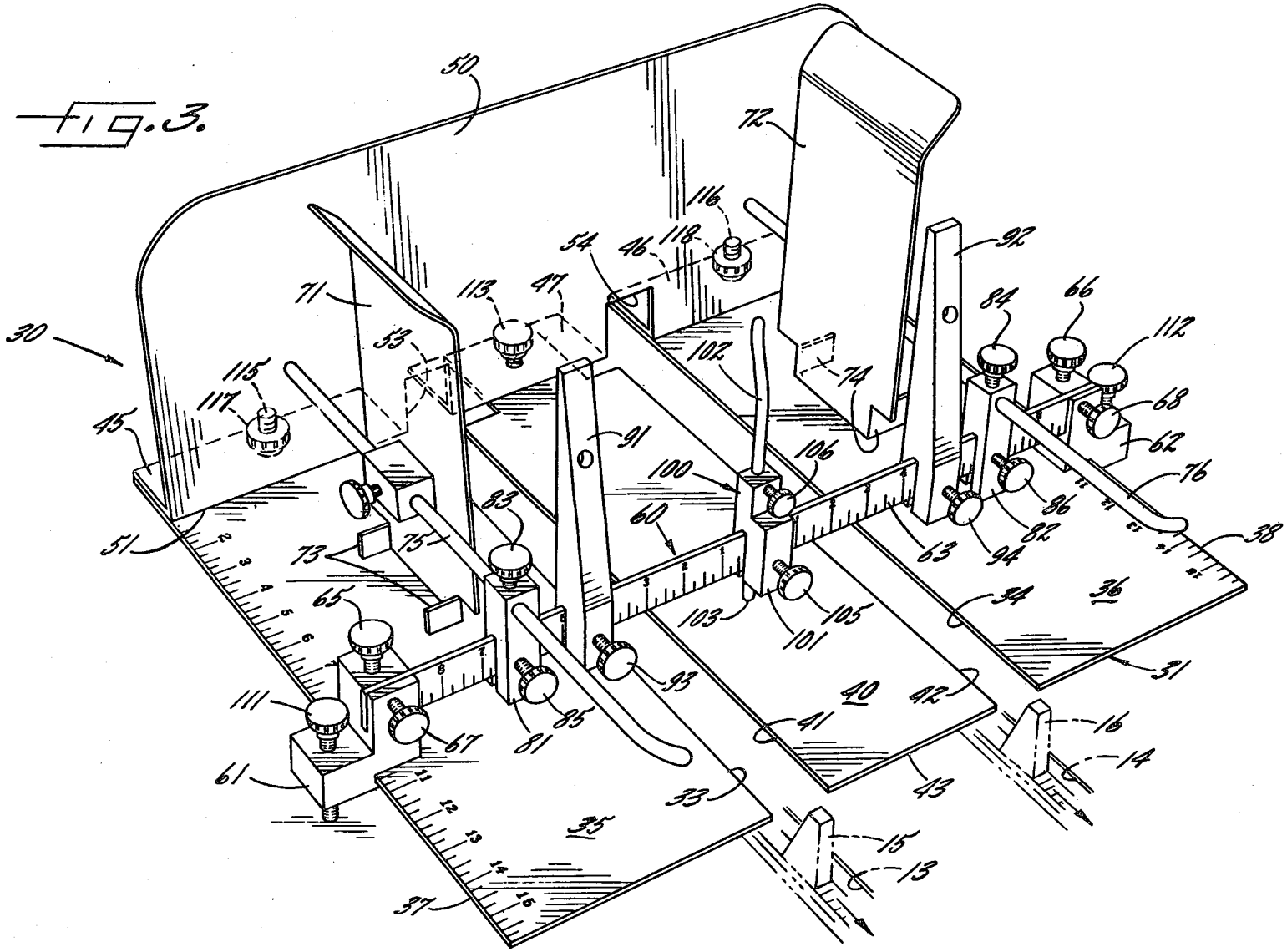

FIG. 3 shows the auxiliary feed hopper in perspective.

Figure 4:
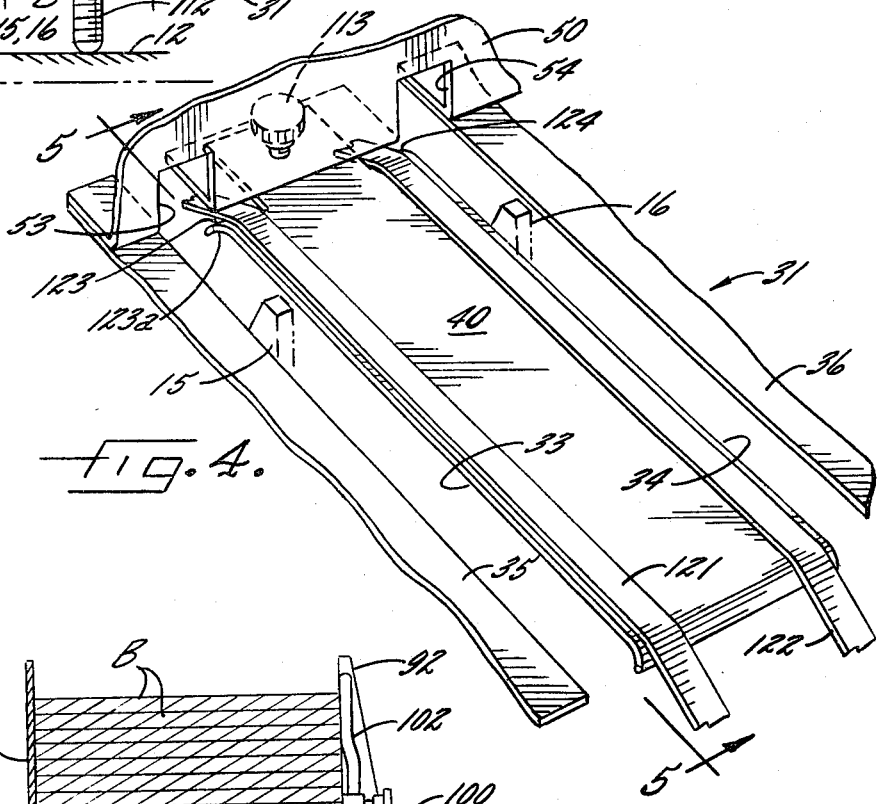

FIG. 4 is a fragmentary perspective showing a portion of the hopper of FIG. 3 with optional employment of the flat delivery belt forming a part of the saddle binder conveyor assembly.

Figure 5:
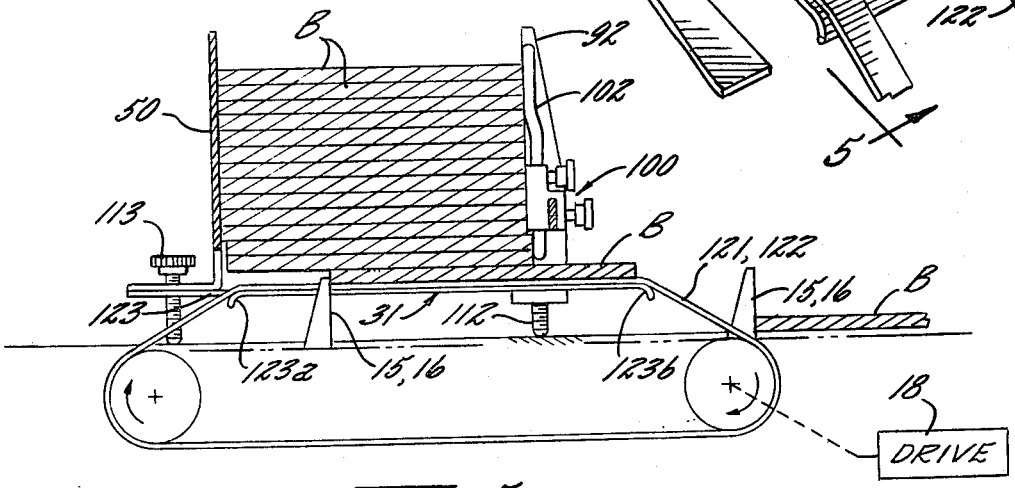

FIG. 5 is a fragmentary section, in elevation, taken along line 5—5 in FIG. 4, showing the manner in which the delivery belts are trained over the base plate of the hopper.

While the invention has been described in connection with a preferred embodiment, it will be understood that I do not intend to be limited to the particular embodiment shown but intend, on the contrary, to cover the various alternative and equivalent constructions included within the spirit and scope of the appended claims.

Figure 1:
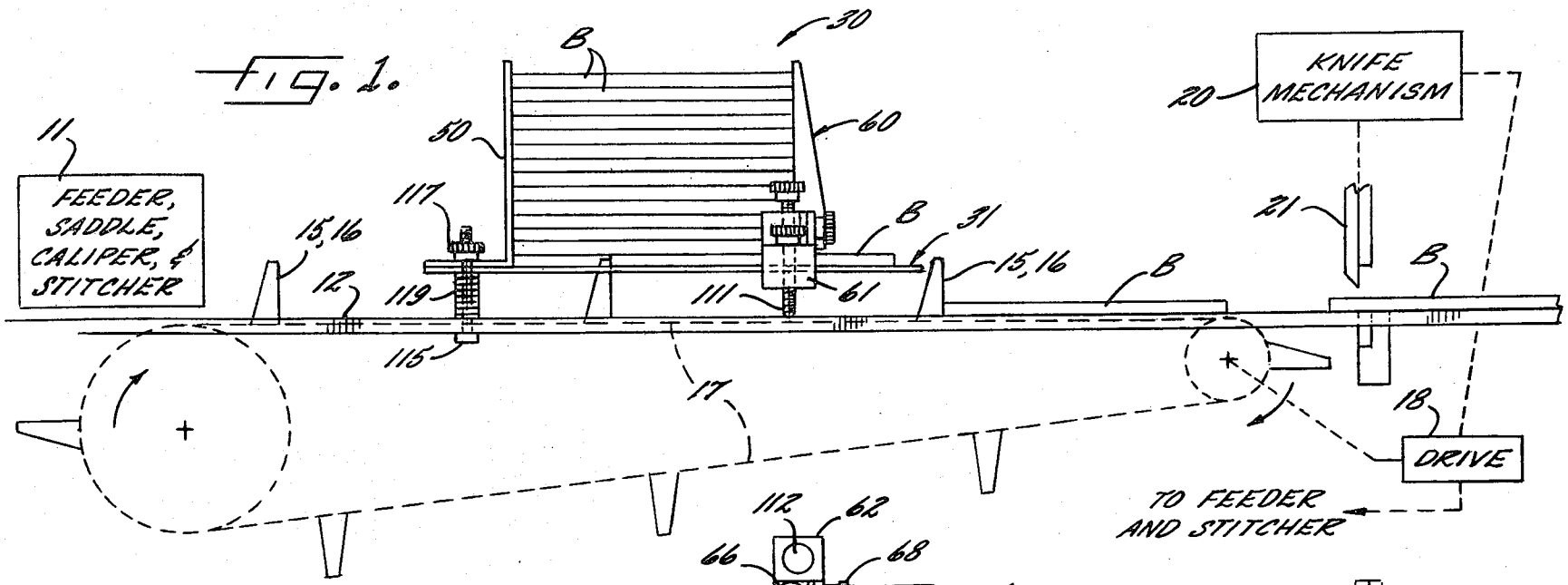
FIG. 1 is a partially diagrammatic side elevation of an auxiliary feed hopper constructed in accordance with the present invention secured in operating position on the delivery bed of a saddle type binding machine.

Turning now to the drawings, there is shown in FIGS. 1 and 2, in diagrammatic form, a unitized saddle binder of modern design including a feeder, saddle, caliper and stitcher grouped together and indicated at 11, at the output of which is a delivery bed 12 having a pair of lug clearance slots 13, 14 formed therein. Upstanding pairs of in-feed lugs 15, 16 project through the slots at regularly spaced intervals. The lugs are mounted on a chain or the like 17 which is recessed under the delivery bed and which forms part of a continuous conveyor assembly. The lugs are driven by a machine drive 18.

Also powered by the drive 18, and synchronized with the movement of the in-feed lugs, is a knife mechanism 20 which is equipped with knives 21 for trimming the front, head and foot of each book. It will be understood that the knife mechanism includes triggering means (not shown) for initiating downward movement of the knives timed with arrival of a book in trimming position. For the details of construction and operation of a unitized saddle binder reference is made to the catalogues and literature published by McCain Manufacturing Corp. at the address given above.

In accordance with the present invention an auxiliary feed hopper is provided for permitting the feeding and trimming, in a saddle binder, of perfect bound books. The hopper includes a base plate having a pair of longitudinally extending slots registering with the slots in the delivery bed, with pedestals for supporting the base plate horizontally superimposed above the delivery bed. A rear stock plate is secured along its lower edge to the base plate and projects vertically, oriented in a direction at right angles to the slots. A front stock guide and a pair of side stock guides supported on the base plate are movably mounted to form a receptacle for snugly receiving a stack of perfect bound books between them. The front stock guide is spaced above the base plate and provided with an adjustable, downwardly projecting barrier for permitting the lowermost book in the stack to feed past the barrier while restraining the remainder of the stack.

The pedestals supporting the base plate are adjustable for elevating the base plate relative to the delivery bed to such height that only the tips of the lugs project through the longitudinally extending slots in the plate, the height of the tips above the base plate being less than book thickness and substantially less than the height of the gap under the barrier.

Thus, referring to FIG. 3, I provide an auxiliary feed hopper 30 having a base plate, or delivery tray, 31 formed with a pair of longitudinal slots 33, 34 which register with the slots 13, 14 in the bed. The slots effectively divide the base plate into two side portions 35, 36 having respective lateral edges 37, 38 and a central portion 40 having lateral edges 41, 42 and a front edge 43. Along the back edge of the base plate is a flat apron divided by the slots 33, 34 into three portions 45, 46 and 47. Mounted in vertical position adjacent the apron is a rear stock plate 50 which extends transversely with respect to the longitudinal slots. The rear stock plate 50 is rigidly secured, at its lower edge 51, to the three portions of the base plate making them rigid with one another. Notches 53, 54 are found in the lower edge of the plate for clearance purposes.

Spaced forwardly from the rear stock plate, and extending parallel to it, is a front stock guide generally indicated at 60 which defines a gap through which the lowermost book is fed. The front stock guide includes brackets 61, 62 which engage the side edges 37, 38 of the base plate. A bridge 63 extends between the brackets in a horizontal position spaced above the base plate. The brackets include respective clamping screws 65, 66 for clamping them at equal distances from the stock plate as well as clamping screws 67, 68 for engaging the ends of the bridge 63.

For confining the edges of the stack, side guides 71, 72 are provided having bases 73, 74 respectively which are slidable on the base plate and which hold the side guides in upright position. The side guides are secured to the bridge by respective rods 75, 76. The rods are supported on rod holders 81, 82 respectively having a first set of clamping screws 83, 84 for tightening the rods and a second set of clamping screws 85, 86 for clamping the rod holders onto the bridge.

The front guide includes upstanding guide members 91, 92 which are clamped in adjusted position on the bridge by clamping screws 93, 94 respectively. The upstanding rear plate 50, side guide members 71, 72 and front guide members 91, 92 are all adjustably positionable with respect to one another using scales conveniently provided on the lateral edges 37, 38 of the base plate and on the bridge 63. The members taken together thus provide a pocket for snug reception of a stack of perfect bound books B, the books being, at this point, in the untrimmed state, each book having a thickness t.

In accordance with the invention a barrier is provided as part of the front guide assembly for adjusting the effective height of the gap in accordance with the thickness of the books being fed. This barrier, indicated at 100, includes a bracket 101 mounted on the bridge and carrying an adjustable vertically oriented rod 102 having a lower tip 103. The bracket is secured to the bridge by a clamping screw 105 while the vertical position of the rod is fixed by a clamping screw 106 so that the lower tip of the rod defines a gap g.

Figure 2A:
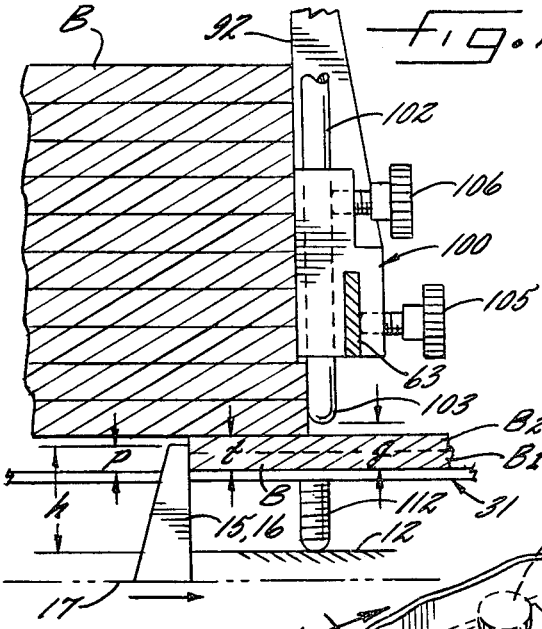
Figure 2B:
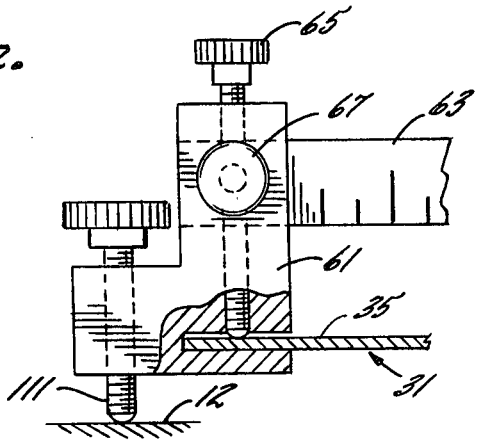

In accordance with the present invention pedestals of adjustable height arranged in a two dimensional pattern elevate the base plate 31 relative to the delivery bed 12 to such a level that only the tips of the lugs project through the longitudinally extending slots in the base plate, the projection p the lug tips being less than the height of the gap g (see FIG. 2*a*). The pedestals in the present instance are formed by a triangle of height adjusting screws threaded into the brackets 61, 62 and into the central portion 47 of the rear apron, the screws being indicated at 111, 112 and 113 respectively. For securing the feed hopper against lateral displacement, a pair of spring loaded stabilizer bolts are provided as shown at 115, 116 penetrating portions 45, 46 of the rear apron and fitted with knurled nuts 117, 118 respectively. The bolts are anchored in suitable holes formed in the delivery bed 12 as shown in FIG. 5, and each bolt is surrounded by a spring of the coiled expansion type 119.

In adjusting the hopper in accordance with the present invention, with the stabilizer bolts disengaged, the pedestal screws 111–113 are turned to elevate the base plate until the tip projection p (FIG. 2*a*) of the in-feed lugs 15, 16 is slightly less than the thickness t of the books B. The barrier clamping screw 106 is then loosened and the barrier rod 102 is adjusted so that its lower tip 103 defines a gap g which is a small amount greater than the book thickness. It follows from this that the tip height p is always somewhat less than the height of the gap g, resulting in the feeding of the books one by one from the hopper upon engagement by a pair of the in-feed lugs. The stabilizer bolts are then engaged tightened to the point where all three of the pedestal screws are firmly seated on the delivery bed.

By following the procedure described immediately above, just the right degree of engagement can be obtained between the lugs and the book being fed regardless of the height h of the lugs or the thickness t of the book. Thus, the auxiliary feed hopper may be employed with any unitized saddle binder regardless of lug height. Moreover, by making the slots 33, 34 on the base plate rather wide, the slots will be in register with the lug clearance slots of practically all commercially available saddle binding machines. Accordingly, the auxiliary feed hopper described above is of universal utility and may be applied to a wide range of saddle binders of the unitized type without any rebuilding or modification thereof.

In use, after adjusting the pedestal screws to achieve the conditions set forth in FIG. 2*a*, a stack of books is placed in the hopper and the drive is activated. The lowermost book in the stack is engaged along its edge by the pair of lugs 15, 16, causing the book to move through the gap. Upon clearing the front edge of the base plate the book drops down onto the surface of the delivery bed 12 where conveyance by the lugs continues until the book occupies the trimmer where the knife mechanism 20 is triggered lowering the knives 21 at front, head and foot positions, following which the trimmed book is ejected into the delivery (by means not shown) where it takes its place in a stack in readiness for periodic removal.

It is one of the features of the present invention that the production rate of the trimmer can be multiplied by two, three or even four, depending upon the thickness of the book, and limited only by the thickness cutting capacity of the knives. The reason for this is that, whereas the books in the saddle binder as normally operated are fed and trimmed one by one, the auxiliary feed hopper of the present invention is under no such limitation and can be adjusted to feed books in multiple provided, of course, that they are not too thick. This can be readily visualized in FIG. 2*a* by considering that the book B having a thickness t is replaced by two books B1 and B2 separated by the dotted line. In similar fashion three books having a total thickness t may be simultaneously fed and simultaneously trimmed. In this way the production capability of the trimmer in a conventional saddle binder is greatly enhanced.

It is one of the features of the auxiliary feed hopper that it is capable of making use of auxiliary conveyor belts, provided on some models of saddle binders, for the purpose of propelling the perfect bound books. For example, in some saddle binders a thin conveyor belt is provided between the clearance slots 13, 14 in the delivery bed. Such belt may either be in a single section or in twin sections such as 121, 122 (see FIGS. 4 and 5). For providing access to the belts at the rear of the hopper, notches 123, 124 are formed at the rear ends of the lateral edges 41, 42 of the central portion 40 of the base plate. For smooth guidance of the belt, the metal forming the base plate may be bent so that it curves downwardly as indicated at 123*a*, at the rear end, and 123*b* at the front end.

It will be understood that the portions 121, 122 of the belt are driven in synchronism with one another and at a speed which is synchronized with the lugs by suitable connection with the drive 18 (FIG. 5). The augmented propelling force provided by belt friction is particularly desirable where the books being fed are relatively thin or fragile or where there is friction between adjacent books by reason of high stacking. It should be particularly noted that the belt need not be modified or rerouted. All that is necessary is that the belt sections be fed through the respective notches 123, 124. If the belt is of stretchable material this can be done simply by lifting the belt from the delivery bed and stretching it over the base plate. If the belt is not stretchable the belt pulley may be loosened to provide the necessary amount of slack which adds but little to the installation time.

It will be apparent that the objects set forth at the beginning have been amply realized. The invention permits the automatic delivery and trimming of perfect bound books in saddle binder equipment intended for exclusive use with saddle bound books. The auxiliary feed hopper frees and dispenses perfect bound books at a precise time synchronized with the operation of the trimming knives without necessity for tampering with any mechanical or control element, without making any electrical connection, and with no modification of the delivery bed. The hopper is highly versatile and can be easily and quickly adjusted for feeding of perfect bound books having a wide range of page size and thickness. The high speed capability of the feeding and trimming mechanisms normally provided in a modern saddle binder are preserved and, indeed, multiplied by reason of the fact that perfect bound books can be fed in groups limited only by the thickness cutting capacity of the trimming knives. No skill is required for installation or operation, and the unit is not only economical but also durable, indeed, capable of outlasting the machine with which it is used.

While it is preferred, for the sake of simplicity, to mount the hopper on pedestals in the form of adjusting screws, it will be understood that the term "pedestal" is a general one covering any means for supporting the base plate at a predetermined, and preferably adjustable, distance from the delivery bed. The term "two-dimensional pattern" refers to the fact that the pedestals are spaced both laterally and longitudinally to provide planar support. While the vertical member at the rear of the hopper has been described as a "plate," it will be understood that the term is used in a general sense of means defining a guiding surface. The same applies to the side plates.

While it is preferred to use a separately adjustable barrier, it will be understood that the barrier, if desired, may be fixed to the bridge and the bridge itself may be vertically adjusted to determine the height of the gap without departing from the invention.

The invention has been described in connection with its primary and intended use, that is, the feeding, for trimming and delivery, of perfect bound books on a machine intended exclusively for the assembly, stitching and trimming of saddle bound volumes. The present feeder has other uses which are quite unique. One is the feeding of other than perfect bound volumes; that is, the feeder may be stacked with saddle bound volumes bound in the same or different machine and even unbound materials for specialized purposes. Most surprising of all, the present feed hopper may be employed as a combiner of volumes. In such usage the basic saddle binding machine may be allowed to operate in the usual way with the conveyor lugs feeding individual saddle bound volumes across the delivery bed and under the present feed hopper, the rearmost pedestal screw 113 being unscrewed to provide the necessary clearance, the conveyor belts being left in their normal operating position on the bed of the saddle binder. With the feed hopper adjusted so that the tips of the conveyor lugs project through the base plate as described, each pair of lugs will, additionally, take along a volume from the bottom of the stack. Such volume will, at the front edge of the base plate simply drop on top of the volume already engaged by the lugs for feeding to the trimmer, and for delivery, as a "twin" volume, which is a function not performed by any other apparatus of comparable construction or of comparable simplicity.

I claim:

1. A saddle binder having a delivery bed and including a three-knife trimmer at the end of the bed, the bed having a pair of slots with successive pairs of upstanding infeed lugs extending therethrough at regularly spaced intervals and with means for driving the lugs in unison synchronized with the knives in the trimmer for transporting books one by one into the trimmer, an auxiliary feed hopper for permitting the trimming, in the saddle binder, of perfect bound books comprising, in combination, a base plate having a pair of longitudinally extending slots, means for supporting the base plate horizontally superimposed above the delivery bed with the slots in the base plate and delivery bed in register with one another, a rear stock plate secured along its lower edge to the base plate and projecting vertically therefrom in a direction at right angles to the slots, a front stock guide supported on the base plate and spaced from the rear stock plate and parallel thereto, side stock guides spaced on the base plate parallel to one another, the front stock guide and side stock guides being adjustably movable with respect to the base plate and having means for clamping them in position for snugly receiving a stack of perfect bound books between them, means for supporting the front stock guide spaced above the base plate to form a gap to permit the lowermost book in the stack to feed thereunder while holding back the remainder of the stack, the front stock guide including an adjustable barrier projecting downwardly therefrom for adjusting the effective height of the gap in accordance with the thickness of the books being fed, the supporting means for the base plate including pedestals of adjustable height under the base plate spaced from one another in a two dimensional pattern for elevating the base plate relative to the delivery bed to such height that only the tips of the lugs project through the longitudinally extending slots, the height of the tips above the base plate being less than the height of the gap under the barrier.

2. A saddle binder having a delivery bed and including a three-knife trimmer at the end of the bed, the bed having a pair of slots with successive pairs of upstanding infeed lugs extending therethrough at regularly spaced intervals and with means for driving the lugs in unison synchronized with the knives in the trimmer for transporting books one by one into the trimmer, an auxiliary feed hopper for permitting the trimming, in the saddle binder, of perfect bound books comprising, in combination, a base plate having a pair of longitudinally extending sots, means for supporting the base plate horizontally superimposed above the delivery bed with the slots in the base plate and delivery bed in register with one another, a rear stock plate secured along its lower edge to the base plate and projecting vertically therefrom in a direction at right angles to the slots, the base plate having side edges parallel to one another, brackets at the side edges having means for clamping the same in positions equally spaced from the stock plate, a front stock guide including a bridge extending between the brackets and spaced above the base plate, side stock guides spaced on the base plate parallel to one another, the side stock guides each being adjustably secured to the bridge for snugly receiving between them a stack of perfect bound books, a barrier secured to the bridge and projecting downwardly therefrom to form a gap to permit the lowermost book in the stack to feed under the bridge while holding back the remainder of the stack, the barrier being adjustable for adjusting the height of the gap in accordance with the thickness of the books being fed, the supporting means for the base plate including pedestals of adjustable height under the base plate and spaced from one another in a two-dimensional pattern for elevating the base plate relative to the delivery bed to such height that only the tips of the lugs project through the longitudinally extending slots, the height of the tips above the base plate being less than the height of the gap under the barrier.

3. A saddle binder having a delivery bed and including a three-knife trimmer at the end of the bed, the bed having a pair of slots with successive pairs of upstanding infeed lugs extending therethrough at regularly spaced intervals and with means for driving the lugs in unison synchronized with the knives in the trimmer for transporting books one by one into the trimmer, an auxiliary feed hopper for permitting the trimming, in the saddle binder, of perfect bound books comprising, in combination, a base plate having a pair of longitudinally extending slots, means for supporting the base plate horizontally superimposed above the delivery bed with the slots in the base plate and delivery bed in register with one another, a rear stock plate secured along its lower edge to the base plate and projecting vertically therefrom in a direction at right angles to the direction of the slots, the base plate having side edges parallel to one another, brackets secured to the side edges at positions equally spaced from the rear stock plate, a front stock guide including a bridge supported at its ends on the brackets, the bridge being parallel to and spaced upwardly from the base plate, side stock guides spaced parallel to one another, each of the side stock guides having a horizontal supporting rod arranged parallel thereto, rod supports on the bridge for respectively receiving the supporting rods, the brackets and rod supports being adjustable in position on the side edges and on the bridge respectively permitting the front stock guide and side stock guides to be positioned for snug reception of a stack of perfect bound books, a barrier member on the bridge projecting downwardly therefrom to form a gap with respect to the base plate, the barrier member being adjustable vertically for adjustment of the effective height of the gap in accordance with the thickness of the books being fed, the supporting means for the base plate including pedestals of adjustable height under the base plate spaced from one another in a two-dimensional pattern for elevating the base plate relative to the delivery bed to such height that only the tips of the lugs project through the longitudinally extending slots, the height of the tips above the base plate being less than the height of the gap under the barrier with the result that the lowermost book is engaged by the lugs for transport through the gap while the remainder of the stack is held back.

4. A saddle binder having a delivery bed and including a three-knife trimmer at the end of the bed, the bed having a pair of slots with successive pairs of upstanding infeed lugs extending therethrough at regularly spaced intervals together with a thin endless transport belt lying between the slots and with means for driving the belt and the lugs in unison synchronized with the knives in the trimmer for urging the books one by one into the trimmer, an auxiliary feed hopper for permitting the trimming, in the saddle binder, of perfect bound books comprising, in combination, a base plate having a top surface and formed with a pair of longitudinally extending slots, means for supporting the base plate horizontally superimposed above the delivery bed with the slots in the base plate and delivery bed in register with one another and with the transport belt stretched over the top surface of the base plate, a rear stock plate secured along its lower edge to the base plate and projecting vertically therefrom in a direction at right angles to the slots, a front stock guide supported on the base plate and spaced from the rear stock plate and parallel thereto, side stock guides on the base plate spaced from and parallel to one another, the front stock guide and the side stock guides being adjustably movable with respect to the base plate and having means for clamping them in position for snugly receiving a stack of perfect bound books between them, means for supporting the front stock guide spaced above the base plate to form a gap to permit the lowermost book in the stack to feed thereunder while holding back the stack, the front stock guide including an adjustable barrier projecting downwardly therefrom for adjusting the effective height of the gap in accordance with the thickness of the books being fed, the means for supporting the base plate including pedestals of adjustable height under the base plate spaced from one another in a two-dimensional pattern for elevating the base plate relative to the delivery bed to such height that only the tips of the lugs project through the longitudinally extending slots, the height of the tips above the base plate being less than the height of the gap under the barrier.

5. The combination as claimed in claim 2 or in claim 3 in which there is secured to the bridge an upstanding guide member parallel to the rear stock plate for alignment of the front end of the stack.

6. The combination as claimed in claim 1 or claim 2 or claim 3 or claim 4 in which at least a portion of the pedestals include bolts penetrating the delivery bed and the base plate, with associated coil springs for biasing the base plate upwardly with respect to the bed.

7. The combination as claimed in claim 2 in which the barrier is in the form of a vertical rod mounted on the bridge so that the lower end of the rod defines the gap with means for axially adjusting the rod with respect to the bridge.

* * * * *